US012292197B2

(12) United States Patent
Knapton et al.

(10) Patent No.: US 12,292,197 B2
(45) Date of Patent: May 6, 2025

(54) FUEL SPRAY NOZZLE

(71) Applicant: ROLLS-ROYCE plc, London (GB)

(72) Inventors: Jonathan Knapton, Derby (GB); Nicholas M. Brown, Nottingham (GB)

(73) Assignee: Rolls-Royce PLC, London (GB)

( * ) Notice: Subject to any disclaimer, the term of this patent is extended or adjusted under 35 U.S.C. 154(b) by 65 days.

(21) Appl. No.: 18/168,912

(22) Filed: Feb. 14, 2023

(65) Prior Publication Data

US 2023/0358405 A1 Nov. 9, 2023

(51) Int. Cl.

| | |
|---|---|
| ***F23R 3/30*** | (2006.01) |
| ***F23R 3/28*** | (2006.01) |
| ***F23R 3/34*** | (2006.01) |

(52) U.S. Cl.

CPC ..... *F23R 3/30* (2013.01); *F23R 3/343* (2013.01); *F23R 3/286* (2013.01)

(58) Field of Classification Search

CPC .. F23R 3/28; F23R 3/283; F23R 3/286; F23R 3/30

See application file for complete search history.

(56) References Cited

U.S. PATENT DOCUMENTS

| | | | | |
|---|---|---|---|---|
| 9,310,073 | B2 * | 4/2016 | Buelow | F23R 3/343 |
| 2004/0148938 | A1 * | 8/2004 | Mancini | F23R 3/343 60/740 |
| 2004/0250547 | A1 | 12/2004 | Mancini et al. | |
| 2007/0028619 | A1 | 2/2007 | Spooner | |
| 2010/0115955 | A1 | 5/2010 | Goeke et al. | |
| 2012/0047903 | A1 | 3/2012 | Williams et al. | |
| 2012/0227408 | A1 * | 9/2012 | Buelow | F23R 3/343 239/553 |
| 2012/0228405 | A1 * | 9/2012 | Buelow | F23R 3/343 239/463 |
| 2013/0200179 | A1 | 8/2013 | Buelow et al. | |

(Continued)

FOREIGN PATENT DOCUMENTS

| | | |
|---|---|---|
| EP | 2497922 A2 | 9/2012 |
| EP | 2570727 A2 | 3/2013 |
| EP | 3798517 A1 | 3/2021 |

OTHER PUBLICATIONS

Great Britain search report dated Aug. 22, 2022, issued in GB Patent Application No. 2202803.9.

(Continued)

*Primary Examiner* — William H Rodriguez

(57) ABSTRACT

A fuel spray nozzle includes a fuel circuit having in series a gallery, circumferentially spaced passages arranged in a row around the nozzle, and an annular spin chamber. Each passage has an inlet for receiving a respective portion of the fuel from the gallery and a metering orifice for discharging its portion of the fuel. The passages are configured such that, when the flow of liquid fuel to the inlet port is shut off, a respective differential static pressure develops across stagnant liquid fuel remaining between the inlet and the metering orifice of each passage, and the passages are further configured such that one or more selected passages develop a different differential static pressure to the remaining passages causing a flow of purging air to enter the gallery from the combustor through the selected passages and exit through the remaining passages, thereby purging the gallery and the passages of fuel.

13 Claims, 5 Drawing Sheets

(56) References Cited

U.S. PATENT DOCUMENTS

| | | | | |
|---|---|---|---|---|
| 2015/0285501 | A1* | 10/2015 | DiCintio | F23R 3/346<br>60/740 |
| 2016/0223201 | A1* | 8/2016 | Zink | F23D 11/10 |

OTHER PUBLICATIONS

European search report dated Jul. 24, 2023, issued in EP Patent Application No. 23154374.5.

* cited by examiner

FUEL SPRAY NOZZLE

CROSS-REFERENCE TO RELATED APPLICATIONS

This specification is based upon and claims the benefit of priority from UK Patent Application Number 2202803.9 filed on Mar. 1, 2022, the entire contents of which are incorporated herein by reference.

BACKGROUND

Technical Field

The present invention relates to a fuel spray nozzle for generating a spray of atomised liquid fuel in a combustor of a gas turbine engine.

Description of the Related Art

A gas turbine engine typically comprises, in axial flow arrangement, a fan, one or more compressors, a combustion system and one or more turbines. The combustion system may comprise a plurality of fuel injectors having fuel spray nozzles which combine fuel and air flows and generate sprays of atomised liquid fuel into a combustion chamber. Correct production of the atomised sprays has a significant impact on combustion efficiency.

Conventional injectors for lean-burn combustion systems typically have a pilot fuel circuit and a mains fuel circuit (see for example EP 3798517 A and EP 2570727 A). The pilot fuel circuit produces a central fuel spray from the injector, while the mains fuel circuit produces a coaxial, radially outward fuel spray. In addition to the two fuel flows (within the pilot fuel circuit and the mains fuel circuit), the injectors each have one or more swirling air flows. As well as atomising the fuel, the air flows serve to maintain separation of the pilot and mains fuel flows until the point of ignition, and to define the flow fields and resulting flame shape in the combustion chamber.

The fuel flow in each of the pilot fuel circuit and mains fuel circuit is typically varied throughout the combustion cycle of the combustion system. At certain times during the combustion cycle (i.e. during engine ignition and at low power operation), the mains fuel flow is staged out (i.e. shut off) whilst the pilot fuel flow is maintained.

Selected features of a conventional fuel spray nozzle 150 are herein described with reference to a schematic partially cut-away view of such a nozzle shown in FIG. 1. The fuel spray nozzle has a mains fuel circuit and an annular prefilming surface 156 downstream of it. The mains fuel circuit has in flow series a gallery 152 circumferentially wrapped around the nozzle, plural circumferentially spaced passages 160 arranged in a row around the nozzle, and an annular spin chamber 155. The gallery can include multiple branches, each branch 159 supplying fuel to a number of the passages 160. Although only two branches are shown in FIG. 1, a typical fuel spray nozzle may have a gallery including, e.g. four branches, each branch supplying fuel flow to three passages.

Each of the passages 160 can have an upstream portion 153 and a downstream conditioning portion 154. The upstream portions 153 of the passages 160 are arranged to evenly distribute the fuel flow between the passages 160 for the entire range of flow conditions of the mains fuel flow.

The conditioning portions 154 then impart a circumferential component to their respective portions of the mains fuel flow.

During operation, the mains fuel flow enters the fuel circuit at an inlet port 151, and then flows into the gallery 152. The upstream portions 153 of the passages 160 receive respective portions of the mains fuel flow from the gallery via inlets 157. The portions of the fuel flow are then delivered into the conditioning portions 154 of the respective passages, and from there, into the spin chamber via respective metering orifices 158 of the passages. In FIG. 1, the white circles at the orifices 158 signify their respective sizes which, as shown, are the same for all the passages. The fuel flow from all the passages is recombined in the spin chamber 155. The mains fuel flow is then discharged from an annular exit port 161 at the downstream end of the spin chamber as a swirling flow onto the annular prefilming surface 156 of the nozzle for atomisation at a trailing edge of the surface into a spray of fine droplets.

When the fuel flow to the mains circuit is staged out for pilot-only operation, the temperature of the mains fuel circuit can quickly rise. Consequently, any stagnant fuel retained within the fuel circuit under these circumstances may attain a temperature at which it breaks down into coking products, which in turn may form lacquer on the surface of the injector rendering it susceptible to blockage. Such blockages can cause a non-uniform heat traverse to the turbine across the combustor. This can encourage high cycle fatigue and turbine failure. Additionally, the blockages can lead to undesirably high back pressures in the fuel system.

Aerodynamic nozzle modifications for purging fuel by means of differential static pressures at the prefilmer exit of the nozzle are known in the art (e.g. US 2007/0028619). Such modified nozzles are configured to introduce a static pressure differential across the mains fuel circuit when the flow of liquid fuel to the circuit is shut off, which creates a propulsive force acting on the remaining fuel in the circuit. This promotes purging the circuit of fuel and thus decreases the risk of coking of fuel residues therein.

However, in both conventional and modified spray nozzles, when the fuel flow to the mains fuel circuit is shut off, air flows preferentially follow paths of least resistance within the mains fuel circuit. This causes the circumferentially spaced passages which feed into the annular spin chamber to drain unequally. Consequently, this promotes retention of fuel in some of the passages bypassed by the purging flows of air. Thus, the mains fuel circuit may not be consistently and completely purged of fuel, leading to coking and its associated negative consequences.

It is therefore desirable to provide an improved fuel spray nozzle configured to more consistently and completely purge all such passages of a fuel circuit of fuel when the flow of liquid fuel is staged out.

The present invention has been devised in light of the above considerations.

SUMMARY

In a first aspect, the present invention provides a fuel spray nozzle for generating a spray of atomised liquid fuel in a combustor of a gas turbine engine, wherein the fuel spray nozzle includes: a fuel circuit having an inlet port for receiving a flow of liquid fuel and having an annular exit port for discharging the received fuel as a swirling fuel flow; and an annular prefilming surface downstream of the annular exit port, and configured such that the swirling fuel flow discharged from the exit port spreads, as a film of fuel, across the prefilming surface, whereupon one or more swirling air flows generated by the nozzle shear the fuel film towards a trailing edge of the prefilming surface and atomise the fuel film into a spray of fine droplets; wherein the fuel circuit has in flow series: a gallery which wraps circumferentially around the nozzle and receives the fuel flow from the inlet port; plural circumferentially spaced passages arranged in a row around the nozzle, each passage having an inlet for receiving a respective portion of the fuel flow from the gallery, a metering orifice for discharging its portion of the fuel flow, and being configured to impart a circumferential component to its discharged portion of the fuel flow; and an annular spin chamber which receives the respective discharged portions of the fuel flow from the metering orifices of the passages to form the swirling fuel flow which is discharged at the exit port; and wherein: the passages are configured such that, when the flow of liquid fuel to the inlet port is shut off, a respective differential static pressure develops across stagnant liquid fuel remaining between the inlet and the metering orifice of each passage, and the passages are further configured such that one or more selected passages develop a different differential static pressure to the remaining passages, the different differential static pressure causing a flow of purging air to enter the gallery from the combustor through the selected passages and exit through the remaining passages, thereby purging the gallery and the passages of fuel.

Advantageously, by configuring selected of the passages to develop different differential static pressures to the remaining passages, it is possible to generate paths of least resistance within the fuel circuit such that when the flow of liquid fuel to the circuit is shut off, the purging air flow necessarily passes through all the passages via the gallery. Consequently, the gallery and all passages can be completely purged of fuel, which reduces the risk of fuel coking therein. This can improve the reliability and longevity of the fuel spray nozzle, and of the engine (e.g. its turbines) more generally.

Effectively, by configuring selected of the passages to develop different differential static pressures to the remaining passages, a syphonic purge of the passages is promoted in which a propulsive force on the fuel inside the passages is exerted and a faster and more complete purge of the passages and the gallery can be achieved.

This improved effectiveness of the purging process can eliminate a need for a separate heat exchanger between a mains fuel circuit and a pilot fuel circuit at the fuel spray nozzle tip. This is advantageous as such heat exchangers can be complex to design, difficult to manufacture and add weight to lean-burn fuel spray nozzles.

The selected passages of the fuel spray nozzle may extend further axially into the annular spin chamber than the remaining passages to develop the different differential static pressure. This enhances the static pressure differential across the selected passages during periods of low or no fuel supply to exert a propulsive force on the fuel that drains it from the passages and gallery into the spin chamber. However, this configuration also enables the metering orifices of the selected passages to occupy locations within the spin chamber which are more exposed to compressor discharge air, whereas the metering orifices of the remaining passages occupy locations which remain fuel-wetted at the outset of purge. In this way, the surface tension of the fuel at the metering orifices of the selected passages can be reduced relative to that at the metering orifices of the remaining passages. This effectively reduces the threshold differential pressure across the selected passages needed to overcome surface tension and friction. Coupled with the enhanced pressure differential across the selected passages, when the flow of liquid fuel to the inlet port is shut off, this also helps air to preferentially enter through the selected passages and exit through the remaining passages to purge all the passages. As a result, purging can occur at lower nozzle pressure drops, or more rapidly for a given pressure drop.

In one embodiment, an internal geometry of the selected passages may be different from a corresponding internal geometry of the remaining passages to reduce a threshold differential static pressure of the selected passages relative to a corresponding threshold differential static pressure of the remaining passages, whereby a given differential static pressure developed across stagnant liquid fuel remaining between the inlets and the metering orifices of the selected and remaining passages causes a flow of purging air to enter the gallery from the combustor through the selected passages and exit through the remaining passages, thereby purging the gallery and the passages of fuel.

Indeed, in a second aspect, the present invention provides a fuel spray nozzle for generating a spray of atomised liquid fuel in a combustor of a gas turbine engine, wherein the fuel spray nozzle includes: a fuel circuit having an inlet port for receiving a flow of liquid fuel and having an annular exit port for discharging the received fuel as a swirling fuel flow; and an annular prefilming surface downstream of the annular exit port, and configured such that the swirling fuel flow discharged from the exit port spreads, as a film of fuel, across the prefilming surface, whereupon one or more swirling air flows generated by the nozzle shear the fuel film towards a trailing edge of the prefilming surface and atomise the fuel film into a spray of fine droplets; wherein the fuel circuit has in flow series: a gallery which wraps circumferentially around the nozzle and receives the fuel flow from the inlet port; plural circumferentially spaced passages arranged in a row around the nozzle, each passage having an inlet for receiving a respective portion of the fuel flow from the gallery, a metering orifice (58) for discharging its portion of the fuel flow, and being configured to impart a circumferential component to its discharged portion of the fuel flow; and an annular spin chamber which receives the respective discharged portions of the fuel flow from the metering orifices of the passages to form the swirling fuel flow which is discharged at the exit port; and wherein: the passages are configured such that, when the flow of liquid fuel to the inlet port is shut off, a respective differential static pressure develops across stagnant liquid fuel remaining between the inlet and the metering orifice of each passage, and an internal geometry of one or more selected passages is different from a corresponding internal geometry of the remaining passages to reduce a threshold differential static pressure of the selected passages relative to a corresponding threshold differential static pressure of the remaining passages, whereby when a given differential static pressure develops across the stagnant liquid fuel remaining between the inlets and the metering orifices of the selected and remaining passages exceeds the threshold differential static pressure of the selected passages, a flow of purging air is enters the gallery from the combustor through the selected passages and exits through the remaining passages, thereby purging the gallery and the passages of fuel.

In this way also, it is possible to generate paths of least resistance within the fuel circuit such that when the flow of liquid fuel to the circuit is shut off, the purging air flow necessarily passes through all the passages via the gallery.

For example, in a fuel spray nozzle of the first or second aspect, a flow cross-sectional area of the metering orifices of the selected passages may be larger than a flow cross-sectional area of the metering orifices of the remaining passages to reduce the threshold differential static pressure of the selected passages. This configuration can also enhance the static pressure across the selected passages during periods of low or no fuel supply, which in turn can exert a propulsive force on the fuel to drain it from the passages and gallery and into the spin chamber.

Additionally or alternatively, the internal geometry of the selected passages may be different from the corresponding internal geometry of the remaining passages to vary a stagnant liquid fuel meniscus contact angle in the selected passages relative to a corresponding stagnant liquid fuel meniscus contact angle of the remaining passages to reduce the threshold differential static pressure of the selected passages. For example, edges of the inlets to the selected passages may be more chamfered than edges of the inlets to the remaining passages and/or edges of outlets from the selected passages to the spin chamber may be more chamfered than edges of outlets from the remaining passages to the spin chamber to vary the stagnant liquid fuel meniscus contact angle. In this way, meniscus adhesion to the surface of the selected passages can be reduced at such locations, decreasing the resistance for the meniscus to move through the selected passages.

The fuel spray nozzle of the first or second aspect may be further configured such that: the passages are divided into plural mutually exclusive subgroups such that each subgroup contains plural of the passages and each subgroup receives its fuel from a respective branch of the gallery; the gallery is configured such that, when the flow of liquid fuel to the inlet port is shut off, the stagnant fuel remaining in each branch of the gallery is substantially isolated from the stagnant fuel remaining in the other branches of the gallery; and each subgroup contains one of the selected passages and one or more of the remaining passages. This configuration ensures that there is at least one selected passage per branch and therefore when the flow of liquid fuel to the inlet port is shut off, the air flow necessarily passes through each branch to purge the fuel therein. Additionally, as the subgroups of passages are mutually exclusive, and the stagnant fuel remaining in each branch is substantially isolated from the stagnant fuel remaining in the other branches, each subgroup and its respective branch can be purged of fuel independently of the others.

Preferably, each subgroup may contain just one of the selected passages and just one or just two of the remaining passages. A ratio of one selected passage to one or two of the remaining passages helps to ensure more complete purging.

Indeed, in a third aspect, the present invention provides a fuel spray nozzle for generating a spray of atomised liquid fuel in a combustor of a gas turbine engine, wherein the fuel spray nozzle includes: a fuel circuit having an inlet port for receiving a flow of liquid fuel and having an annular exit port for discharging the received fuel as a swirling fuel flow; and an annular prefilming surface downstream of the annular exit port, and configured such that the swirling fuel flow discharged from the exit port spreads, as a film of fuel, across the prefilming surface, whereupon one or more swirling air flows generated by the nozzle shear the fuel film towards a trailing edge of the prefilming surface and atomise the fuel film into a spray of fine droplets; wherein the fuel circuit has in flow series: a gallery which wraps circumferentially around the nozzle and receives the fuel flow from the inlet port; plural circumferentially spaced passages arranged in a row around the nozzle, each passage having an inlet for receiving a respective portion of the fuel flow from the gallery, a metering orifice for discharging its portion of the fuel flow, and being configured to impart a circumferential component to its discharged portion of the fuel flow; and an annular spin chamber which receives the respective discharged portions of the fuel flow from the metering orifices of the passages to form the swirling fuel flow which is discharged at the exit port; and wherein: the passages are divided into plural mutually exclusive subgroups such that each subgroup contains just two of the passages and each subgroup receives its fuel from a respective branch of the gallery; and the gallery is configured such that, when the flow of liquid fuel to the inlet port is shut off, the stagnant fuel remaining in each branch of the gallery is substantially isolated from the stagnant fuel remaining in the other branches of the gallery.

Advantageously, by arranging the passages in mutually exclusive subgroups, each of which contains just two of the passages, any small difference in differential static pressures across stagnant liquid fuel remaining between the inlet and the metering orifice of the two passages when the flow of liquid fuel to the inlet port is shut off (e.g. caused by uneven fluid flow conditions) can produce a lower resistance air path and drive syphonic purging from one passage to the other via the respective branch connecting the two passages. As there are no other passages fed by the branch, there is little danger of unpurged fuel being left behind in those passages.

The fuel spray nozzle of any aspect may be a lean burn nozzle in which the fuel circuit is a mains fuel circuit, and the nozzle further includes a pilot fuel circuit, the mains fuel circuit being stageable to effect pilot-only and pilot-and-mains staging control. However, this does not exclude that the nozzle may be a rich burn nozzle, i.e. without separate pilot and mains fuel circuits for pilot-and-mains staging control.

In a fourth aspect, the present invention provides a gas turbine engine including in flow series: a fan; a compressor; a combustion system including a plurality of fuel injectors each having fuel spray nozzles according to any one of the first to third aspects; and a turbine.

For example, the gas turbine engine of the fourth aspect may further include: a core shaft connecting the turbine to the compressor such that such that the turbine and compressor rotate at the same speed; and a gearbox configured to receive an input from the core shaft and to output drive to the fan so as to drive the fan at a lower rotational speed than the core shaft.

As noted elsewhere herein, the gas turbine engine may comprise a gearbox that receives an input from the core shaft and outputs drive to the fan so as to drive the fan at a lower rotational speed than the core shaft. The input to the gearbox may be directly from the core shaft, or indirectly from the core shaft, for example via a spur shaft and/or gear. The core shaft may rigidly connect the turbine and the compressor, such that the turbine and compressor rotate at the same speed (with the fan rotating at a lower speed).

The gas turbine engine as described and/or claimed herein may have any suitable general architecture. For example, the gas turbine engine may have any desired number of shafts that connect turbines and compressors, for example one, two or three shafts. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft connecting the second turbine to the second compressor. The second turbine, second compressor, and second core shaft may be arranged to rotate at a higher rotational speed than the first core shaft.

In such an arrangement, the second compressor may be positioned axially downstream of the first compressor. The second compressor may be arranged to receive (for example directly receive, for example via a generally annular duct) flow from the first compressor.

The gearbox may be arranged to be driven by the core shaft that is configured to rotate (for example in use) at the lowest rotational speed (for example the first core shaft in the example above). For example, the gearbox may be arranged to be driven only by the core shaft that is configured to rotate (for example in use) at the lowest rotational speed (for example only be the first core shaft, and not the second core shaft, in the example above). Alternatively, the gearbox may be arranged to be driven by any one or more shafts, for example the first and/or second shafts in the example above.

The gearbox may be a reduction gearbox (in that the output to the fan is a lower rotational rate than the input from the core shaft). Any type of gearbox may be used. For example, the gearbox may be a "planetary" or "star" gearbox, as described in more detail elsewhere herein. The gearbox may have any desired reduction ratio (defined as the rotational speed of the input shaft divided by the rotational speed of the output shaft), for example greater than 2.5, for example in the range of from 3 to 4.2, or 3.2 to 3.8, for example on the order of or at least 3, 3.1, 3.2, 3.3, 3.4, 3.5, 3.6, 3.7, 3.8, 3.9, 4, 4.1 or 4.2. The gear ratio may be, for example, between any two of the values in the previous sentence. Purely by way of example, the gearbox may be a "star" gearbox having a ratio in the range of from 3.1 or 3.2 to 3.8. In some arrangements, the gear ratio may be outside these ranges.

In any gas turbine engine as described and/or claimed herein, a combustor may be provided axially downstream of the fan and compressor(s). For example, the combustor may be directly downstream of (for example at the exit of) the second compressor, where a second compressor is provided. By way of further example, the flow at the exit to the combustor may be provided to the inlet of the second turbine, where a second turbine is provided. The combustor may be provided upstream of the turbine(s).

The or each compressor (for example the first compressor and second compressor as described above) may comprise any number of stages, for example multiple stages. Each stage may comprise a row of rotor blades and a row of stator vanes, which may be variable stator vanes (in that their angle of incidence may be variable). The row of rotor blades and the row of stator vanes may be axially offset from each other.

The or each turbine (for example the first turbine and second turbine as described above) may comprise any number of stages, for example multiple stages. Each stage may comprise a row of rotor blades and a row of stator vanes. The row of rotor blades and the row of stator vanes may be axially offset from each other.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

DESCRIPTION OF THE DRAWINGS

Embodiments illustrating the principles of the invention will now be discussed with reference to the accompanying figures in which.

DETAILED DESCRIPTION

Aspects and embodiments of the present invention will now be discussed with reference to the accompanying figures. Further aspects and embodiments will be apparent to those skilled in the art. All documents mentioned in this text are incorporated herein by reference.

Figure 1:
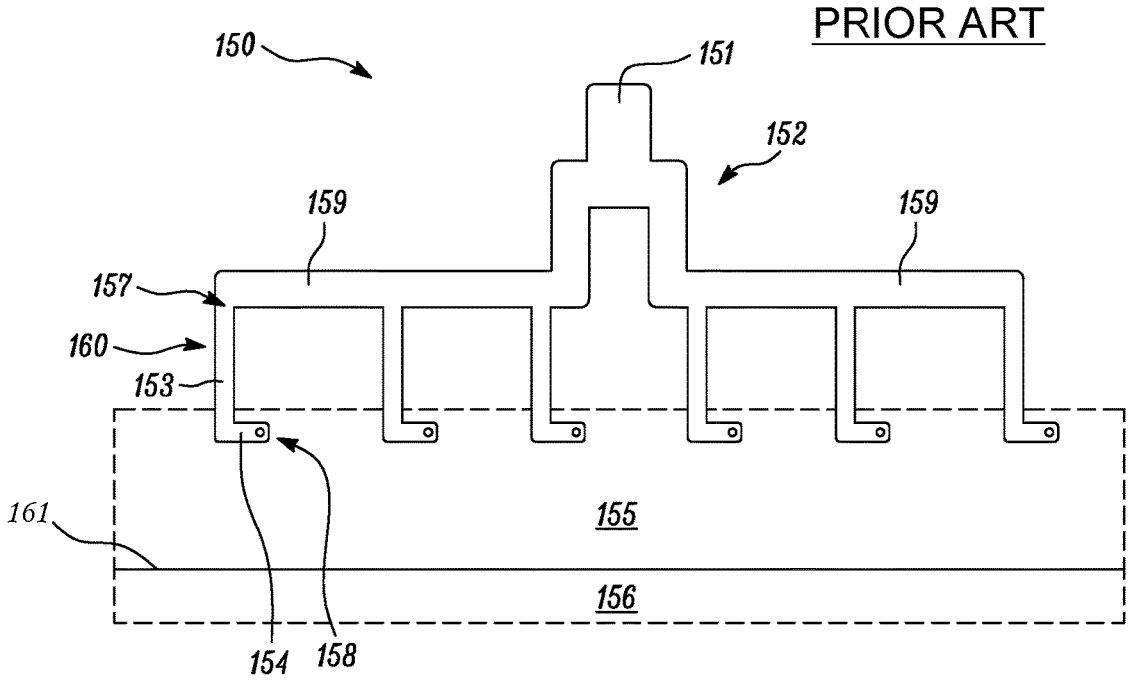
FIG. 1 is a schematic partially cut-away view of selected features of a conventional fuel spray nozzle for a gas turbine engine.
Figure 2:
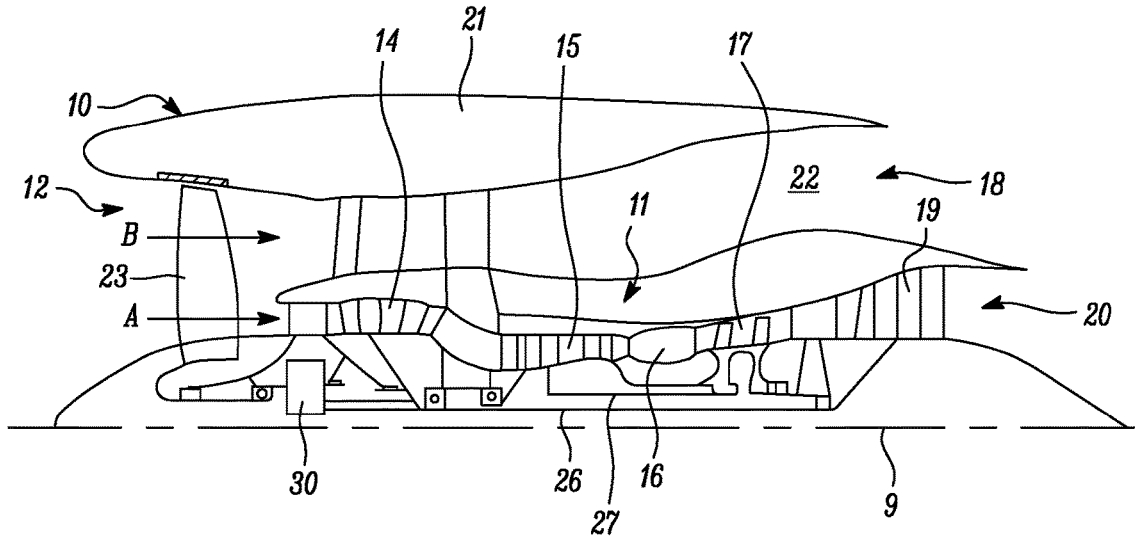
FIG. 2 is a sectional side view of a gas turbine engine.

FIG. 2 illustrates a gas turbine engine 10 having a principal rotational axis 9. The engine 10 comprises an air intake 12 and a propulsive fan 23 that generates two airflows: a core airflow A and a bypass airflow B. The gas turbine engine 10 comprises a core 11 that receives the core airflow A. The engine core 11 comprises, in axial flow series, a low pressure compressor 14, a high-pressure compressor 15, combustion equipment 16, a high-pressure turbine 17, a low pressure turbine 19 and a core exhaust nozzle 20. A nacelle 21 surrounds the gas turbine engine 10 and defines a bypass duct 22 and a bypass exhaust nozzle 18. The bypass airflow B flows through the bypass duct 22. The fan 23 is attached to and driven by the low pressure turbine 19 via a shaft 26 and an epicyclic gearbox 30.

In use, the core airflow A is accelerated and compressed by the low pressure compressor 14 and directed into the high pressure compressor 15 where further compression takes place. The compressed air exhausted from the high pressure compressor 15 is directed into the combustion equipment 16 where it is mixed with fuel and the mixture is combusted. The resultant hot combustion products then expand through, and thereby drive, the high pressure and low pressure turbines 17, 19 before being exhausted through the nozzle 20 to provide some propulsive thrust. The high pressure turbine 17 drives the high pressure compressor 15 by a suitable interconnecting shaft 27. The fan 23 generally provides the majority of the propulsive thrust. The epicyclic gearbox 30 is a reduction gearbox.

Figure 3:
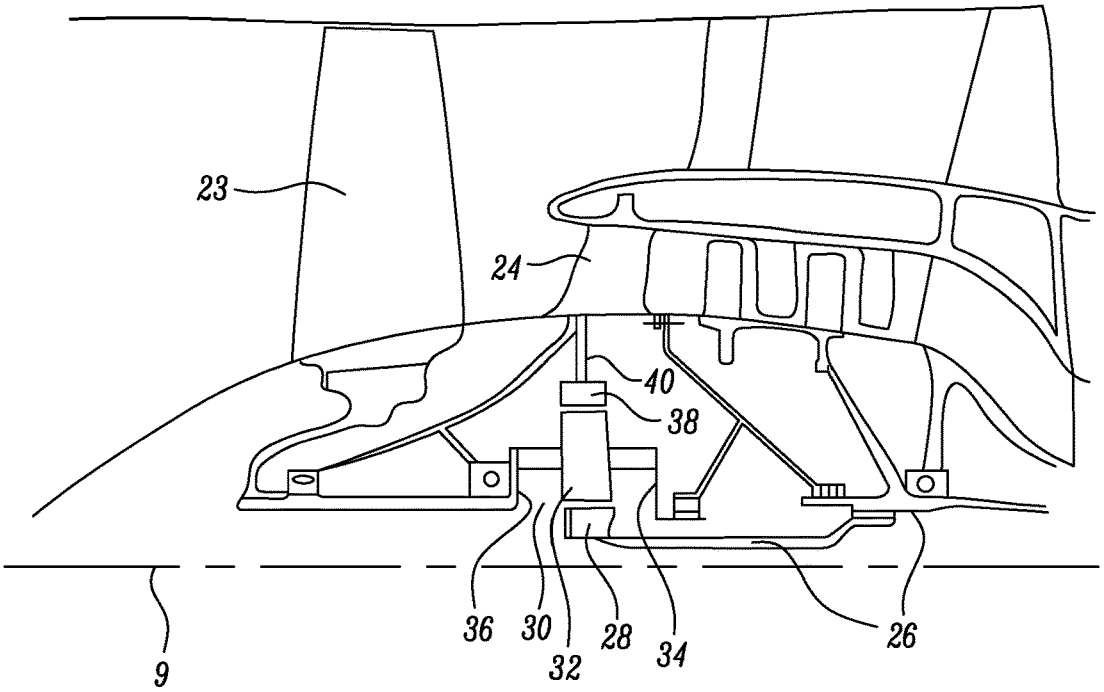
FIG. 3 is a close-up sectional side view of an upstream portion of a gas turbine engine.

An exemplary arrangement for a geared fan gas turbine engine 10 is shown in FIG. 3. The low pressure turbine 19 (see FIG. 2) drives the shaft 26, which is coupled to a sun wheel, or sun gear, 28 of the epicyclic gear arrangement 30. Radially outwardly of the sun gear 28 and intermeshing therewith is a plurality of planet gears 32 that are coupled together by a planet carrier 34. The planet carrier 34 constrains the planet gears 32 to precess around the sun gear 28 in synchronicity whilst enabling each planet gear 32 to rotate about its own axis. The planet carrier 34 is coupled via linkages 36 to the fan 23 in order to drive its rotation about the engine axis 9. Radially outwardly of the planet gears 32 and intermeshing therewith is an annulus or ring gear 38 that is coupled, via linkages 40, to a stationary supporting structure 24.

Note that the terms "low pressure turbine" and "low pressure compressor" as used herein may be taken to mean the lowest pressure turbine stages and lowest pressure compressor stages (i.e. not including the fan 23) respectively and/or the turbine and compressor stages that are connected together by the interconnecting shaft 26 with the lowest rotational speed in the engine (i.e. not including the gearbox output shaft that drives the fan 23). In some literature, the "low pressure turbine" and "low pressure compressor" referred to herein may alternatively be known as the "intermediate pressure turbine" and "intermediate pressure compressor". Where such alternative nomenclature is used, the fan 23 may be referred to as a first, or lowest pressure, compression stage.

Figure 4:
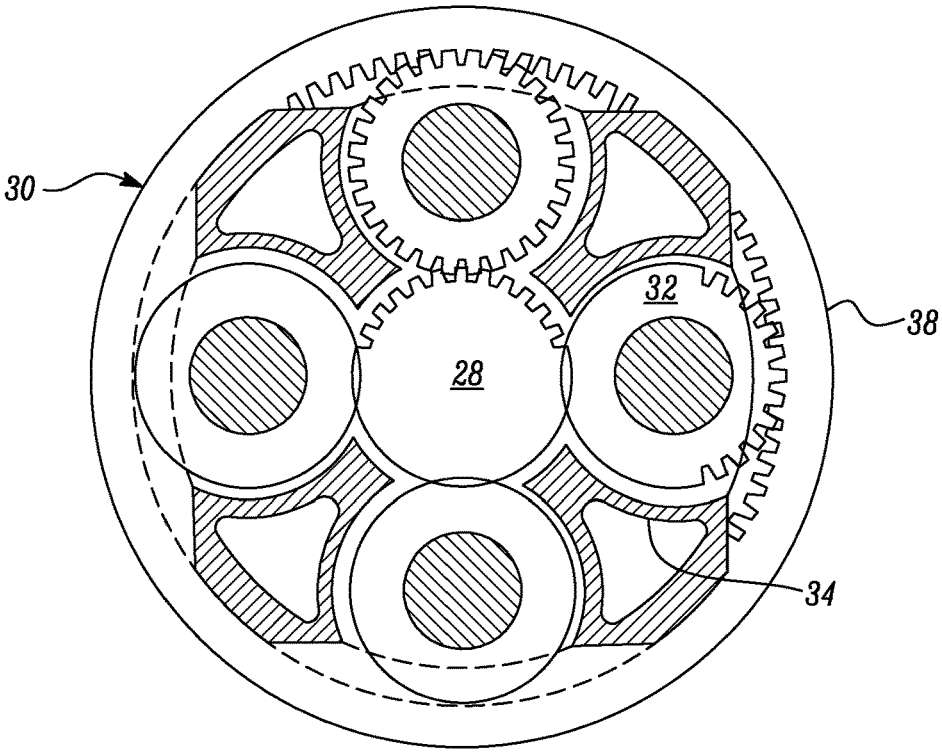
FIG. 4 is a partially cut-away view of a gearbox for a gas turbine engine.

The epicyclic gearbox 30 is shown by way of example in greater detail in FIG. 4. Each of the sun gear 28, planet gears 32 and ring gear 38 comprise teeth about their periphery to intermesh with the other gears. However, for clarity only exemplary portions of the teeth are illustrated in FIG. 4. There are four planet gears 32 illustrated, although it will be apparent to the skilled reader that more or fewer planet gears 32 may be provided within the scope of the claimed invention. Practical applications of a planetary epicyclic gearbox 30 generally comprise at least three planet gears 32.

The epicyclic gearbox 30 illustrated by way of example in FIGS. 2 and 3 is of the planetary type, in that the planet carrier 34 is coupled to an output shaft via linkages 36, with the ring gear 38 fixed. However, any other suitable type of epicyclic gearbox 30 may be used. By way of further example, the epicyclic gearbox 30 may be a star arrangement, in which the planet carrier 34 is held fixed, with the ring (or annulus) gear 38 allowed to rotate. In such an arrangement the fan 23 is driven by the ring gear 38. By way of further alternative example, the gearbox 30 may be a differential gearbox in which the ring gear 38 and the planet carrier 34 are both allowed to rotate.

It will be appreciated that the arrangement shown in FIGS. 2 and 3 is by way of example only, and various alternatives are within the scope of the present disclosure. Purely by way of example, any suitable arrangement may be used for locating the gearbox 30 in the engine 10 and/or for connecting the gearbox 30 to the engine 10. By way of further example, the connections (such as the linkages 36, 40 in the FIG. 3 example) between the gearbox 30 and other parts of the engine 10 (such as the input shaft 26, the output shaft and the fixed structure 24) may have any desired degree of stiffness or flexibility. By way of further example, any suitable arrangement of the bearings between rotating and stationary parts of the engine (for example between the input and output shafts from the gearbox and the fixed structures, such as the gearbox casing) may be used, and the disclosure is not limited to the exemplary arrangement of FIG. 3. For example, where the gearbox 30 has a star arrangement (described above), the skilled person would readily understand that the arrangement of output and support linkages and bearing locations would typically be different to that shown by way of example in FIG. 3.

Accordingly, the present disclosure extends to a gas turbine engine having any arrangement of gearbox styles (for example star or planetary), support structures, input and output shaft arrangement, and bearing locations.

Optionally, the gearbox may drive additional and/or alternative components (e.g. the intermediate pressure compressor and/or a booster compressor).

Other gas turbine engines to which the present disclosure may be applied may have alternative configurations. For example, such engines may have an alternative number of compressors and/or turbines and/or an alternative number of interconnecting shafts. By way of further example, the gas turbine engine shown in FIG. 2 has a split flow nozzle 18, 20 meaning that the flow through the bypass duct 22 has its own nozzle 18 that is separate to and radially outside the core engine nozzle 20. However, this is not limiting, and any aspect of the present disclosure may also apply to engines in which the flow through the bypass duct 22 and the flow through the core 11 are mixed, or combined, before (or upstream of) a single nozzle, which may be referred to as a mixed flow nozzle. One or both nozzles (whether mixed or split flow) may have a fixed or variable area. Whilst the described example relates to a turbofan engine, the disclosure may apply, for example, to any type of gas turbine engine, such as an open rotor (in which the fan stage is not surrounded by a nacelle) or turboprop engine, for example. In some arrangements, the gas turbine engine 10 may not comprise a gearbox 30.

The geometry of the gas turbine engine 10, and components thereof, is defined by a conventional axis system, comprising an axial direction (which is aligned with the rotational axis 9), a radial direction (in the bottom-to-top direction in FIG. 2), and a circumferential direction (perpendicular to the page in the FIG. 2 view). The axial, radial and circumferential directions are mutually perpendicular.

The combustion equipment 16 of the engine 10 includes a plurality of fuel injectors having lean burn fuel spray nozzles which combine pilot and mains fuel flows, and swirling air flows to generate sprays of atomised liquid fuel into a combustion chamber. The mains fuel flow can be staged in and out to provide, as required, pilot-only operation and pilot-and-mains operation.

FIGS. 5 to 10 are schematic partially cut-away views of selected features of respective variants of a fuel spray nozzle of one of the injectors. The variants of FIGS. 5 to 10 each have a mains fuel circuit and an annular prefilming surface 56 downstream of it. The fuel circuit has in flow series: a gallery 52 circumferentially wrapped around the nozzle, plural circumferentially spaced passages 60*a*, 60*b* (FIGS. 5, 6, 8, 9, and 10) or plural circumferentially spaced passages 60 (FIG. 7) arranged in a row around the nozzle, and an annular spin chamber 55.

The gallery 52 includes multiple branches, each branch 59 supplying fuel to a number of the passages 60*a*, 60*b*; 60. The passages are divided into plural mutually exclusive subgroups such that each subgroup contains plural of the passages and each subgroup receives its fuel from a respective branch of the gallery 52. When the flow of liquid fuel to the inlet port 51 is shut off, the stagnant fuel remaining in each branch of the gallery is substantially isolated from the stagnant fuel remaining in the other branches of the gallery. Thus, each subgroup and its respective branch are purged of fuel independently of the others.

Although only two branches are shown in each of FIGS. 5 to 10, the gallery 52 typically includes more branches 59. For example, the spray nozzles of FIGS. 5 and 6, in which each branch supplies three passages 60*a*, 60*b*, may have four such branches, and the spray nozzles of FIGS. 7 to 9, in which each branch supplies two passages 60*a*, 60*b*; 60, may have six such branches. However, the number of passages receiving fuel from the same branch of the gallery is not thus limited, and neither is the number of branches of the same gallery.

Next, each of the passages 60*a*, 60*b*; 60 has an upstream portion 53*a*, 53*b*; 53 and a downstream conditioning portion 54*a*, 54*b*; 54. The upstream portions of the passages extend axially and end at respective metering orifices 58*a*, 58*b*; 58, and are configured to evenly distribute the fuel flow between the passages for the entire range of flow conditions of the mains fuel flow. The conditioning portions then extend circumferentially from the ends of the upstream portions to impart a circumferential component to their respective portions of the mains fuel flow.

During operation, the fuel flow enters the fuel circuit at an inlet port 51, and then flows into the gallery 52. The upstream portions 53*a*, 53*b*; 53 of the passages 60*a*, 60*b*; 60 receive respective portions of the fuel flow from the gallery via inlets 57*a*, 57*b*; 57. The portions of the fuel flow are then delivered into the conditioning portions 54*a*, 54*b*; 54 of the respective passages, and from there, into the spin chamber. In FIGS. 5 to 9, the white circles signify the respective sizes of the respective metering orifices 58*a*, 58*b*; 58 of the passages. The fuel flow from all the passages is recombined in the spin chamber 55. The fuel flow is then discharged from an annular exit port 61 at the downstream end of the spin chamber as a swirling flow onto the annular prefilming surface 56 of the nozzle for atomisation at a trailing edge of the surface into a spray of fine droplets.

When the flow of liquid fuel to the inlet port 51 is shut off, a respective differential static pressure develops across stagnant liquid fuel remaining between the inlet 57*a*, 57*b;* 57 and the metering orifice 58*a*, 58*b*; 58 of each passage 60*a*, 60*b*; 60. Additionally, in the variant of FIG. 5, one or more selected passages 60*a* are configured to develop a different differential static pressure to the remaining passages 60*b*. The different differential static pressure causes a flow of purging air to enter the gallery from the combustor through the selected passages 60*a* and exit through the remaining passages 60*b*, thereby purging the gallery and the passages of fuel.

More particularly, this configuration of the selected passages 60*a* generates paths of least resistance within the fuel circuit such that when the flow of liquid fuel to the circuit is shut off, the purging air flow necessarily passes through all the passages 60*a*, 60*b* via the gallery 52. Consequently, the gallery and all passages are completely purged of fuel, which reduces the risk of fuel coking therein. This can improve the reliability and longevity of the fuel spray nozzle 50, and of the engine 10 (e.g. its turbines 17, 19) more generally.

Effectively, by configuring selected of the passages 60*a* to develop different differential static pressures to the remaining passages 60*b*, a syphonic purge of the passages 60*a*, 60*b* is promoted in which a propulsive force on the fuel inside the passages is exerted and a faster and more complete purge of the passages and the gallery 52 is achieved.

Figure 5:
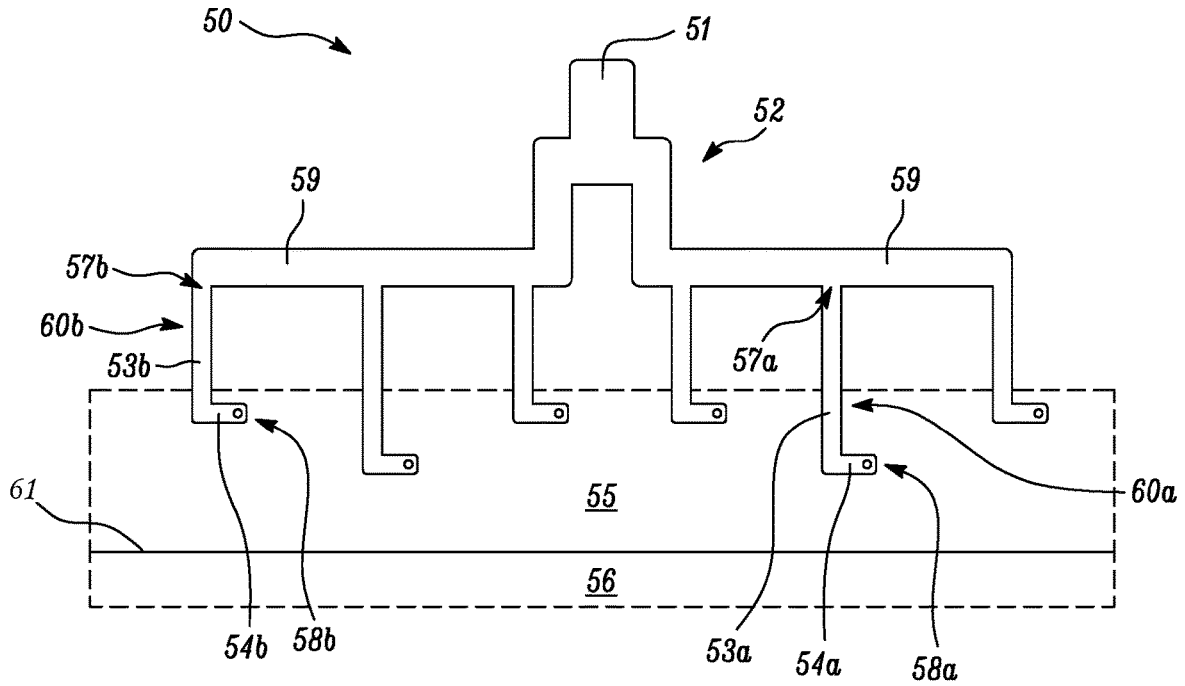
FIGS. 5 to 10 are schematic partially cut-away views of selected features of respective variants of a fuel spray nozzle.

In the variant of FIG. 5, each branch 59 of the gallery 52 supplies fuel to three passages, one of which is a selected passage 60*a* and the other two are remaining passages 60*b*. The selected passage 60*a* extends further axially into the spin chamber 55 than the two remaining passages 60*b* to develop the different differential static pressure as a result of a spin chamber medium internal flow field. This enhances the static pressure differential across the selected passage 60*a* during periods of low or no fuel supply to exert a propulsive force on any stagnant liquid fuel, the propulsive force draining the fuel from the passages and gallery 52 into the spin chamber 55.

Additionally, the metering orifice 58*a* of the selected passage 60*a* occupies a location within the spin chamber, which is more exposed to compressor discharge air, whereas the metering orifices 58*b* of the two remaining passages 60*b* occupy locations which are fuel-wetted at the outset of purge. In this way, the surface tension of the fuel at the metering orifice of the selected passage is reduced relative to that at the metering orifices of the remaining passages. This effectively reduces the threshold differential pressure across the selected passage needed to overcome surface tension and friction. Coupled with the enhanced pressure differential across the selected passage, when the flow of liquid fuel to the inlet port 51 is shut off, air preferentially enters through the selected passage and exits through the remaining passages to purge all the passages 60*a*, 60*b*. As a result, fuller purging occurs at lower nozzle pressure drops, or more rapidly for a given pressure drop.

Figure 6:
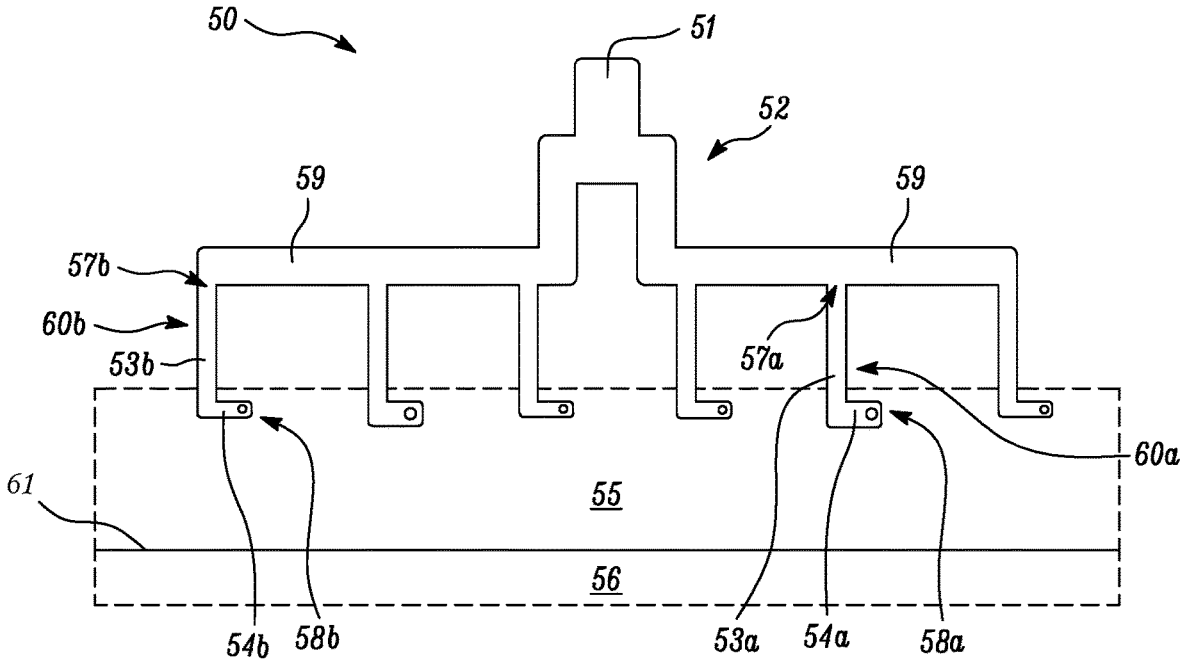

In the variant of FIG. 6, each branch 59 of the gallery 52 supplies fuel to three passages, one of which is a selected passage 60*a* and the other two are remaining passages 60*b*. However, unlike in FIG. 5, in this variant a flow cross-sectional area of the metering orifice 58*a* of the selected passage 60*a* is greater than the corresponding flow cross-sectional area of the metering orifices 58*b* of the remaining passages 60*b* in the branch 59. In other words, the selected passage has a different internal geometry such that the internal diameter of the metering orifice 58*a* of the selected passage 60*a* is larger compared to the diameters of the metering orifices 58*b* of the remaining passages 60*b* in the branch. This is illustrated by the differently sized white circles representing the metering orifices 58*a*, 58*b* in FIG. 6.

With this configuration, air preferentially enters through the selected passage 60*a* and exits through the remaining passages 60*b* of the branch, because the larger internal diameter of the metering orifice 58*a* of the selected passage causes it to have a lower threshold differential static pressure for air to enter than the remaining passages 60*b*. Thus the air necessarily passes through all the passages 60*a*, 60*b* and across their respective branch 59 to purge the passages 60*a*, 60*b* completely of any stagnant fuel.

Figure 10:
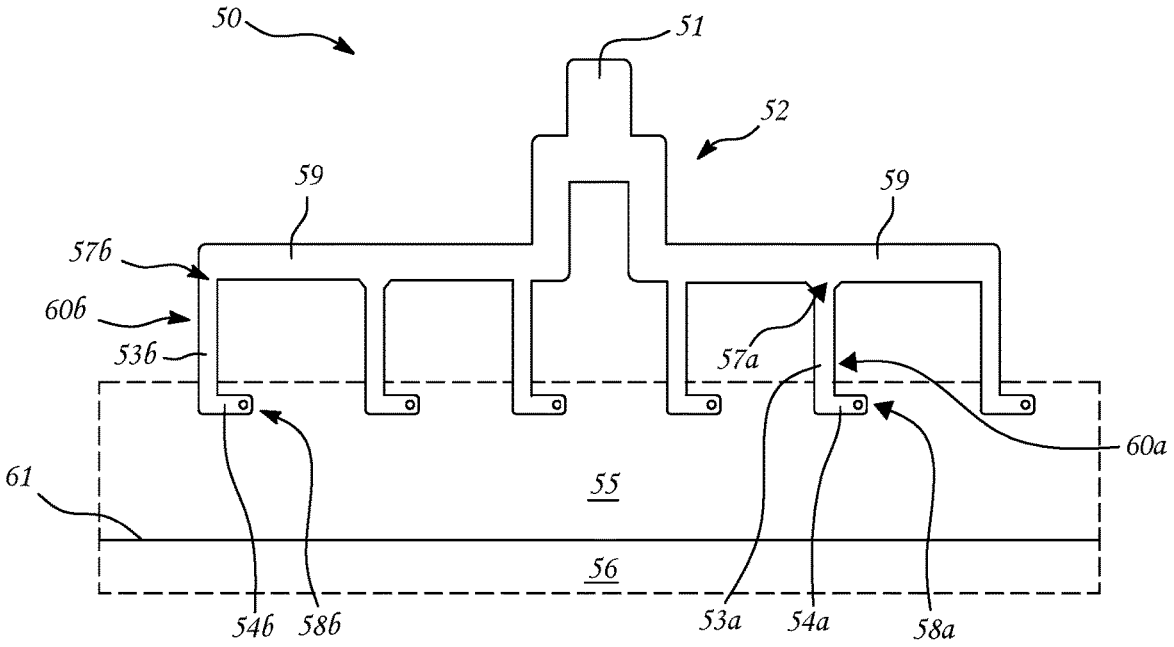

Another option for changing the internal geometry of the selected passages 60*a* from a corresponding internal geometry of the remaining passages 60*b* to lower the threshold differential static pressure for the selected passages is to change a geometry that affects a stagnant liquid fuel meniscus contact angle in the passages when the flow of liquid fuel to the inlet port 51 is shut off. This can be achieved as shown in FIG. 10, for example, by forming the edges of the inlets 57*a* to the selected passages 60*a* to be more chamfered than the edges of the inlets 57*b* to the remaining passages 60*b* and/or by forming the edges of outlets from the selected passages 60*a* to the spin chamber 55 to be more chamfered than the edges of the corresponding outlets from the remaining passages 60*b*. Such chamfered edges vary the contact angle that a fuel meniscus forms with the inlet/outlet of the selected passage 60*a*.

Although not illustrated, a fuel spray nozzle can combine the approach of the variant of FIG. 5, in which one or more selected passages are configured to develop a different differential static pressure to the remaining passages, and the approach of the variant of FIG. 6, in which the selected passages have an internal geometry which reduces their threshold differential static pressure.

Figure 7:
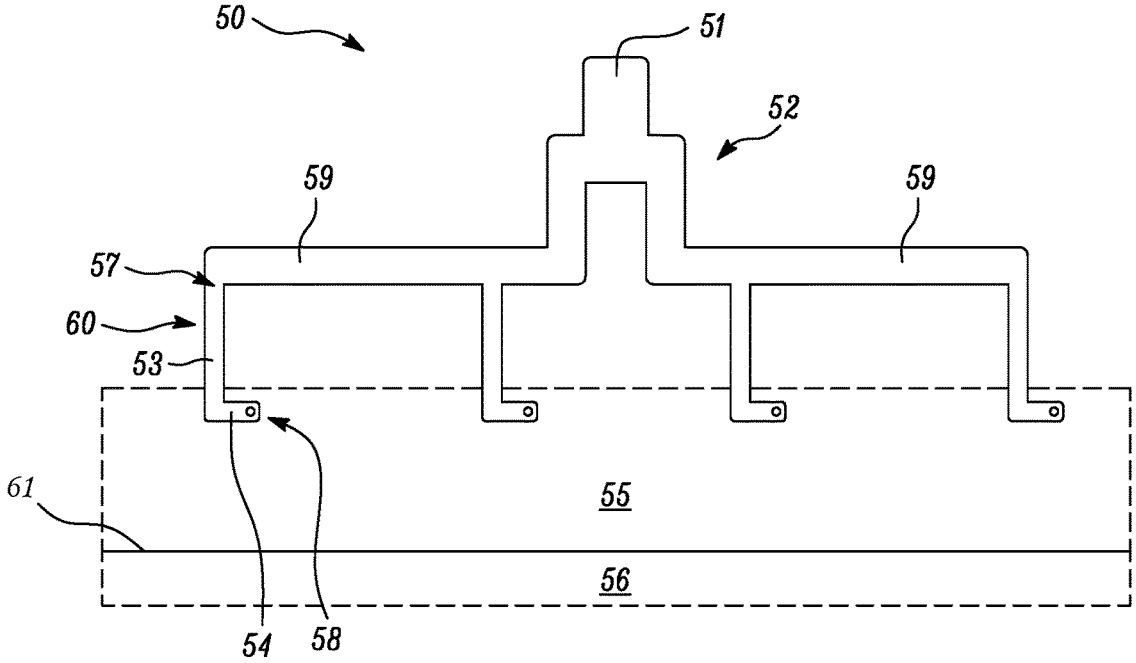

FIG. 7 shows a further variant where each branch 59 of the gallery 52 supplies fuel to just two passages 60. Unlike the variants of FIGS. 5 and 6, the passages 60 in the variant of FIG. 7 are nominally identical in terms of their lengths and flow cross-sectional areas, i.e. metering orifice diameters. However, by arranging the passages in mutually exclusive subgroups, each of which contains just two of the passages, any small difference in differential static pressures across stagnant liquid fuel remaining between the inlet 57 and the metering orifice 58 of the two passages when the flow of liquid fuel to the inlet port 51 is shut off can produce a lower resistance air path and drive syphonic purging from one passage to the other via the respective branch 59 connecting the two passages. As there are no other passages fed by the branch, there is little danger of unpurged fuel being left behind in those passages.

However, a consequence of this approach is that more branches 59 of the gallery 52 are required to maintain the same number of passages 60 around the nozzle.

Figure 8:
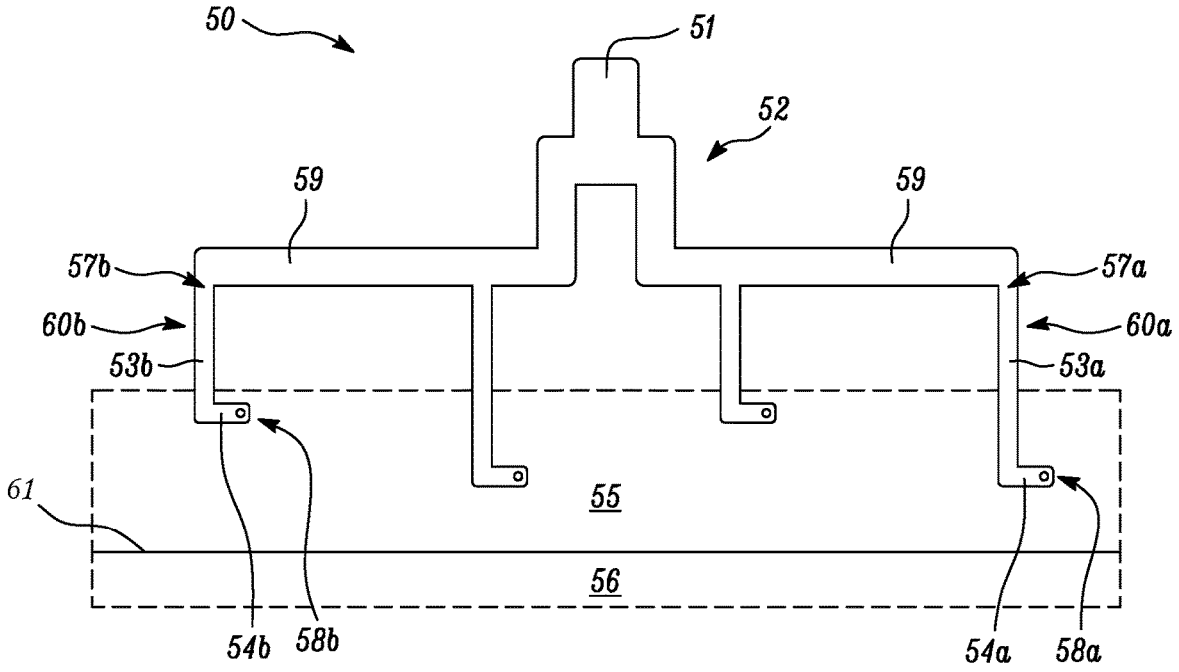
Figure 9:
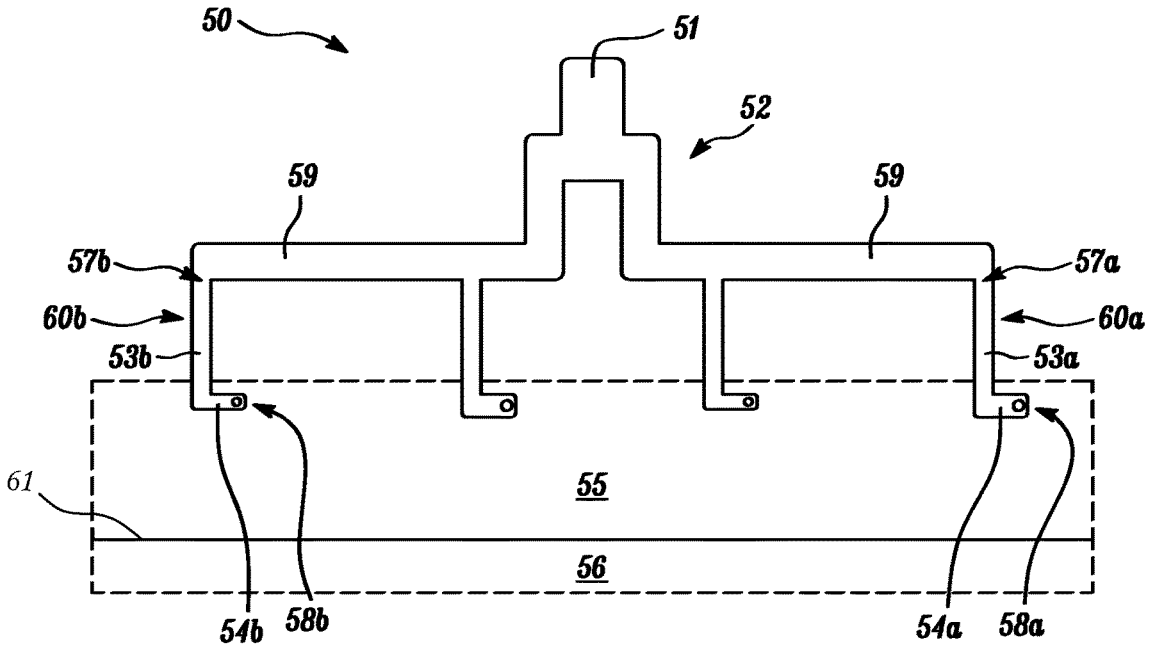

The variants of FIGS. 8 and 9 combine the approach of the variants of FIGS. 5 and 6 with the approach of the variant of FIG. 7. More particularly, in the variants of each of FIGS. 8 and 9, each branch 59 of the gallery 52 supplies fuel to just two passages, one of which is a selected passage 60*a* and the other of which is a remaining passage 60*b*.

Thus, in FIG. 8, the selected passage 60*a* extends further axially into the spin chamber 55 than the remaining passage 60*b*, as described in detail in relation to FIG. 5, to develop the enhanced static pressure differential across the selected passage needed to overcome surface tension and flow losses (e.g. friction and turbulence).

In FIG. 9, by contrast, a flow cross-sectional area of the metering orifice 58*a* of the selected passage 60*a* is different from a corresponding flow cross-sectional area of the metering orifice 58*b* of the remaining passage 60*b*, as described in detail in relation to FIG. 6, to reduce the threshold differential static pressure of the selected passage.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

We claim:

1. A fuel spray nozzle for generating a spray of atomised liquid fuel in a combustor of a gas turbine engine, wherein the fuel spray nozzle includes:

a fuel circuit having an inlet port for receiving a flow of liquid fuel and having an annular exit port for discharging the received fuel as a swirling fuel flow; and an annular prefilming surface downstream of the annular exit port, and configured such that the swirling fuel flow discharged from the exit port spreads, as a film of fuel, across the prefilming surface, whereupon one or more swirling air flows generated by the nozzle shear the fuel film towards a trailing edge of the prefilming surface and atomise the fuel film into a spray of fine droplets;

wherein the fuel circuit has in flow series:

a gallery which wraps circumferentially around the nozzle and receives the fuel flow from the inlet port;

plural circumferentially spaced passages arranged in a row around the nozzle, each passage having an inlet for receiving a respective portion of the fuel flow from the gallery, a metering orifice for discharging its portion of the fuel flow, and being configured to impart a circumferential component to its discharged portion of the fuel flow; and an annular spin chamber which receives the respective discharged portions of the fuel flow from the metering orifices of the passages to form the swirling fuel flow which is discharged at the exit port; and wherein:

the passages are configured such that, when the flow of liquid fuel to the inlet port is shut off, a respective differential static pressure develops across stagnant liquid fuel remaining between the inlet and the metering orifice of each passage, and the passages are further configured such that one or more selected passages develop a different differential static pressure to the remaining passages, the different differential static pressure causing a flow of purging air to enter the gallery from the combustor through the selected passages and exit through the remaining passages, thereby purging the gallery and the passages of fuel; and wherein the selected passages extend further axially into the annular spin chamber than the remaining passages to develop the different differential static pressure.

2. The fuel spray nozzle according to claim 1, wherein an internal geometry of the selected passages is different from a corresponding internal geometry of the remaining passages to reduce a threshold differential static pressure of the selected passages relative to a corresponding threshold differential static pressure of the remaining passages, whereby a given differential static pressure developed across stagnant liquid fuel remaining between the inlets and the metering orifices of the selected and remaining passages causes a flow of purging air to enter the gallery from the combustor through the selected passages and exit through the remaining passages, thereby purging the gallery and the passages of fuel.

3. The fuel spray nozzle according to claim 2, wherein a flow cross-sectional area of the metering orifices of the selected passages is larger than a flow cross-sectional area of the metering orifices of the remaining passages to reduce the threshold differential static pressure of the selected passages.

4. The fuel spray nozzle according to claim 2, wherein the internal geometry of the selected passages is different from the corresponding internal geometry of the remaining passages to vary a stagnant liquid fuel meniscus contact angle in the selected passages relative to a corresponding stagnant liquid fuel meniscus contact angle of the remaining passages to reduce the threshold differential static pressure of the selected passages.

5. The fuel spray nozzle according to claim 1, wherein:

the passages are divided into plural mutually exclusive subgroups such that each subgroup contains plural of the passages and each subgroup receives its fuel from a respective branch of the gallery;

the gallery is configured such that, when the flow of liquid fuel to the inlet port is shut off, the stagnant fuel remaining in each branch of the gallery is substantially isolated from the stagnant fuel remaining in the other branches of the gallery; and each subgroup contains one of the selected passages and one or more of the remaining passages.

6. The fuel spray nozzle according to claim 1, which is a lean burn nozzle in which the fuel circuit is a mains fuel circuit, and the nozzle further includes a pilot fuel circuit, the mains fuel circuit being stageable to effect pilot-only and pilot-and-mains staging control.

7. A fuel spray nozzle for generating a spray of atomised liquid fuel in a combustor of a gas turbine engine, wherein the fuel spray nozzle includes:

a fuel circuit having an inlet port for receiving a flow of liquid fuel and having an annular exit port for discharging the received fuel as a swirling fuel flow; and an annular prefilming surface downstream of the annular exit port, and configured such that the swirling fuel flow discharged from the exit port spreads, as a film of fuel, across the prefilming surface, whereupon one or more swirling air flows generated by the nozzle shear the fuel film towards a trailing edge of the prefilming surface and atomise the fuel film into a spray of fine droplets;

wherein the fuel circuit has in flow series:

a gallery which wraps circumferentially around the nozzle and receives the fuel flow from the inlet port;

plural circumferentially spaced passages arranged in a row around the nozzle, each passage having an inlet for receiving a respective portion of the fuel flow from the gallery, a metering orifice for discharging its portion of the fuel flow, and being configured to impart a circumferential component to its discharged portion of the fuel flow; and an annular spin chamber which receives the respective discharged portions of the fuel flow from the metering orifices of the passages to form the swirling fuel flow which is discharged at the exit port; and wherein:

the passages are configured such that, when the flow of liquid fuel to the inlet port is shut off, a respective differential static pressure develops across stagnant liquid fuel remaining between the inlet and the metering orifice of each passage, and an internal geometry of one or more selected passages is different from a corresponding internal geometry of the remaining passages to reduce a threshold differential static pressure of the selected passages relative to a corresponding threshold differential static pressure of the remaining passages, whereby when a given differential static pressure develops across the stagnant liquid fuel remaining between the inlets and the metering orifices of the selected and remaining passages exceeds the threshold differential static pressure of the selected passages, a flow of purging air enters the gallery from the combustor through the selected passages and exits through the remaining passages, thereby purging the gallery and the passages of fuel.

8. The fuel spray nozzle according to claim 7, wherein a flow cross-sectional area of the metering orifices of the selected passages is larger than a flow cross-sectional area of the metering orifices of the remaining passages to reduce the threshold differential static pressure of the selected passages.

9. The fuel spray nozzle according to claim 7, wherein the internal geometry of the selected passages is different from the corresponding internal geometry of the remaining passages to vary a stagnant liquid fuel meniscus contact angle in the selected passages relative to a corresponding stagnant liquid fuel meniscus contact angle of the remaining passages to reduce the threshold differential static pressure of the selected passages.

10. The fuel spray nozzle according to claim 9, wherein edges of the inlets to the selected passages are more chamfered than edges of the inlets to the remaining passages and/or edges of outlets from the selected passages to the spin chamber are more chamfered than edges of outlets from the remaining passages to the spin chamber to vary the stagnant liquid fuel meniscus contact angle.

11. The fuel spray nozzle according to claim 7, wherein:

the passages are divided into plural mutually exclusive subgroups such that each subgroup contains plural of the passages and each subgroup receives its fuel from a respective branch of the gallery;

the gallery is configured such that, when the flow of liquid fuel to the inlet port is shut off, the stagnant fuel remaining in each branch of the gallery is substantially isolated from the stagnant fuel remaining in the other branches of the gallery; and each subgroup contains one of the selected passages and one or more of the remaining passages.

12. The fuel spray nozzle according to claim 11, wherein each subgroup contains just one of the selected passages and just one or just two of the remaining passages.

13. The fuel spray nozzle according to claim 7, which is a lean burn nozzle in which the fuel circuit is a mains fuel circuit, and the nozzle further includes a pilot fuel circuit, the mains fuel circuit being stageable to effect pilot-only and pilot-and-mains staging control.

* * * * *